US006718155B2

(12) United States Patent
Kaji et al.

(10) Patent No.: US 6,718,155 B2
(45) Date of Patent: Apr. 6, 2004

(54) FIXING APPARATUS IN WHICH FIXING SPEED IS SWITCHED DURING CLEANING

(75) Inventors: Keigo Kaji, Chiba (JP); Kenji Nagata, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 64 days.

(21) Appl. No.: 10/067,878

(22) Filed: Feb. 8, 2002

(65) Prior Publication Data

US 2002/0136572 A1 Sep. 26, 2002

(30) Foreign Application Priority Data

Feb. 14, 2001 (JP) ..... 2001-036375

(51) Int. Cl.[7] ..... G03G 21/21
(52) U.S. Cl. ..... 399/354; 399/326; 399/327
(58) Field of Search ..... 400/701, 636.3; 399/326, 327, 346, 357, 328, 332

(56) References Cited

U.S. PATENT DOCUMENTS 5,149,941 A 9/1992 Hirabayashi et al. ..... 219/216
5,257,578 A * 11/1993 Jackson et al. ..... 101/425
5,512,729 A * 4/1996 Kusaka et al. ..... 219/216
6,026,272 A * 2/2000 Kusaka et al. ..... 399/327
6,035,155 A 3/2000 Kaji et al. ..... 399/69
6,243,558 B1 * 6/2001 Oota ..... 399/326
6,295,438 B1 * 9/2001 Fujishiro et al. ..... 399/346
6,305,860 B1 * 10/2001 Park ..... 400/636.3
6,334,041 B1 * 12/2001 Oota ..... 399/326

FOREIGN PATENT DOCUMENTS

JP 63-313182 12/1988

* cited by examiner

*Primary Examiner*—Stephen R. Funk
*Assistant Examiner*—Marvin Crenshaw
(74) *Attorney, Agent, or Firm*—Fitzpatrick, Cella, Harper & Scinto

(57) ABSTRACT

An object of the present invention is to provide a fixing apparatus that has a fixing rotating member for holding and conveying a recording material supporting an unfixed image to perform fixation, driving device for driving the fixing rotating member, a cleaning rotating member for cleaning the fixing rotating member, and contact/separation device for bringing the cleaning rotating member into contact with and away from the fixing rotating member, wherein the driving device drives the fixing rotating member at a predetermined fixing speed during fixation and at a cleaning speed lower than the fixing speed at the time of cleaning by the cleaning rotating member.

11 Claims, 2 Drawing Sheets

FIXING APPARATUS IN WHICH FIXING SPEED IS SWITCHED DURING CLEANING

BACKGROUND OF THE INVENTION

1. Field of the Invention

The present invention relates to a fixing apparatus which is used in an image forming apparatus adopting the electrophotographic system, electrostatic recording system or the like, such as a printer or a copying machine, and which serves to fix an unfixed image on a recording material.

2. Related Art

Conventionally, with regard to an image forming apparatus adopting the electrophotographic system, electrostatic recording system or the like, such as a printer or a copying machine, a fixing apparatus using a heat roller is known as means for fixing an unfixed image on a recording material to the recording material. Such a fixing apparatus has a problem in that it involves large power consumption and that the time required for attaining a temperature at which fixing is possible, that is, the so-called warming-up time, is rather long.

As disclosed in Japanese Patent Application Laid-open No. 63-313182, to overcome the above problems, a fixing apparatus adopting a film fixing system using a heat resisting film has been proposed and put into practical use.

A fixing apparatus adopting the film fixing system is equipped, for example, with a thin and heat resisting rotatable fixing film constituting a film member, a driving roller for rotating the fixing film, a heating member serving as heating means secured in position so as to be in slide contact with the inner peripheral surface of the fixing film, and a pressurizing roller serving as a pressurizing member arranged so as to be held in press contact with the heating member through the intermediation of the fixing film.

The fixing film and the pressurizing roller are rotated at a peripheral velocity which is the same as the recording material conveying speed at least during execution of image fixing processing. By conveying the recording material while pinching it by a fixing nip portion serving as a nip region formed by bringing the pressurizing roller into press contact with the heating member through the intermediation of the fixing film, heat energy of the heating member and pressure from the pressurizing roller are imparted to the visual image on the recording material to soften and fuse the visual image. Further, by discharging the recording material from the fixing nip portion, the visual image is cooled and solidified to be fixed to the recording material.

In a fixing apparatus adopting such a film fixing system, a member like a small diameter aluminum roller (removing member) is brought into contact with the pressurizing roller, whereby residual toner on the pressurizing roller is removed, and staining of the recording material due to staining of the pressurizing roller, jam in which the recording material is entangled with the pressurizing roller, etc. are prevented.

As compared with cleaning means like a web which is arranged so as to be in contact with the fixing roller or the pressurizing roller, the above-mentioned removing member like the aluminum roller leads to a lower cost, so that it is partly adopted in a fixing apparatus adopting the heat roller system.

Residual toner adhering to the surface of the pressurizing roller is once fused and softened at the contact nip position between the pressurizing roller and the removing member, and, immediately after passing the contact nip position, is cooled and solidified on the removing portion, whereby it is removed from the pressurizing roller.

However, in the removing member consisting of an aluminum roller or the like of the above conventional fixing apparatus, toner is not sufficiently fused and softened in the contact nip portion between the pressurizing roller and the removing member if the metal roller is not warmed to a sufficient degree, resulting in poor cleaning performance. Thus, in the fixing system using the heat resisting film which needs no warming up, the metal roller is not suitable. Thus, the residual toner that cannot be collected by the removing member consisting of a metal roller returns to the pressurizing roller to thereby stain the recording material.

Also in the fixing apparatus adopting the heat roller system, in particular, when a thin-walled heat roller whose core thickness is not more than 1 mm is used, the control temperature of the fixing nip portion at standby is kept low and transition to sleep mode occurs in a short time. Thus, the temperature of the pressurizing roller is too low and the metal roller is hard to warm itself up, leading to the same problem as that of the system using the heat resisting film.

In view of this, in a conventionally known system, each time fixing operation is performed on a predetermined number of sheets, the pressurizing roller is rotated to heat the pressurizing roller surface and the cleaning roller by the heating member to thereby fuse and soften the toner, thereby achieving a cleaning effect.

However, to achieve a cleaning effect to solve the above problem, the cleaning process has normally to be performed for approximately 90 seconds, and the next image forming operation cannot be performed during cleaning and there is an increase in power consumption during cleaning.

SUMMARY OF THE INVENTION

It is an object of the present invention to provide a fixing apparatus capable of cleaning a fixing rotating member.

Another object of the present invention is to provide a fixing apparatus which allows switching of the speed of the fixing rotating member between fixation mode and cleaning mode.

Still another object of the present invention is to provide a fixing apparatus comprising: a fixing rotating member for pinching and conveying a recording material supporting an unfixed image to perform fixation; driving means for driving the fixing rotating member; a cleaning rotating member for cleaning the fixing rotating member; and contact/separation means for bringing the cleaning rotating member into contact with and away from the fixing rotating member, wherein the driving means drives the fixing rotating member at a predetermined fixing speed during fixation and at a cleaning speed lower than the fixing speed during cleaning by the cleaning rotating member.

Further object of the present invention will become apparent from the following description.

DETAILED DESCRIPTION OF THE PREFERRED EMBODIMENTS

Preferred embodiments of this invention will now be described in detail with reference to the drawings. It is to be noted that the dimensions, materials, shapes, and positional relationship of the components of these embodiments are not to be construed restrictively unless otherwise specified.

First Embodiment

An image forming apparatus according to the first embodiment of the present invention will be described with reference to FIGS. 1 and 2.

First, the image forming apparatus of this embodiment will be described with reference to FIG. 1.

Figure 1:
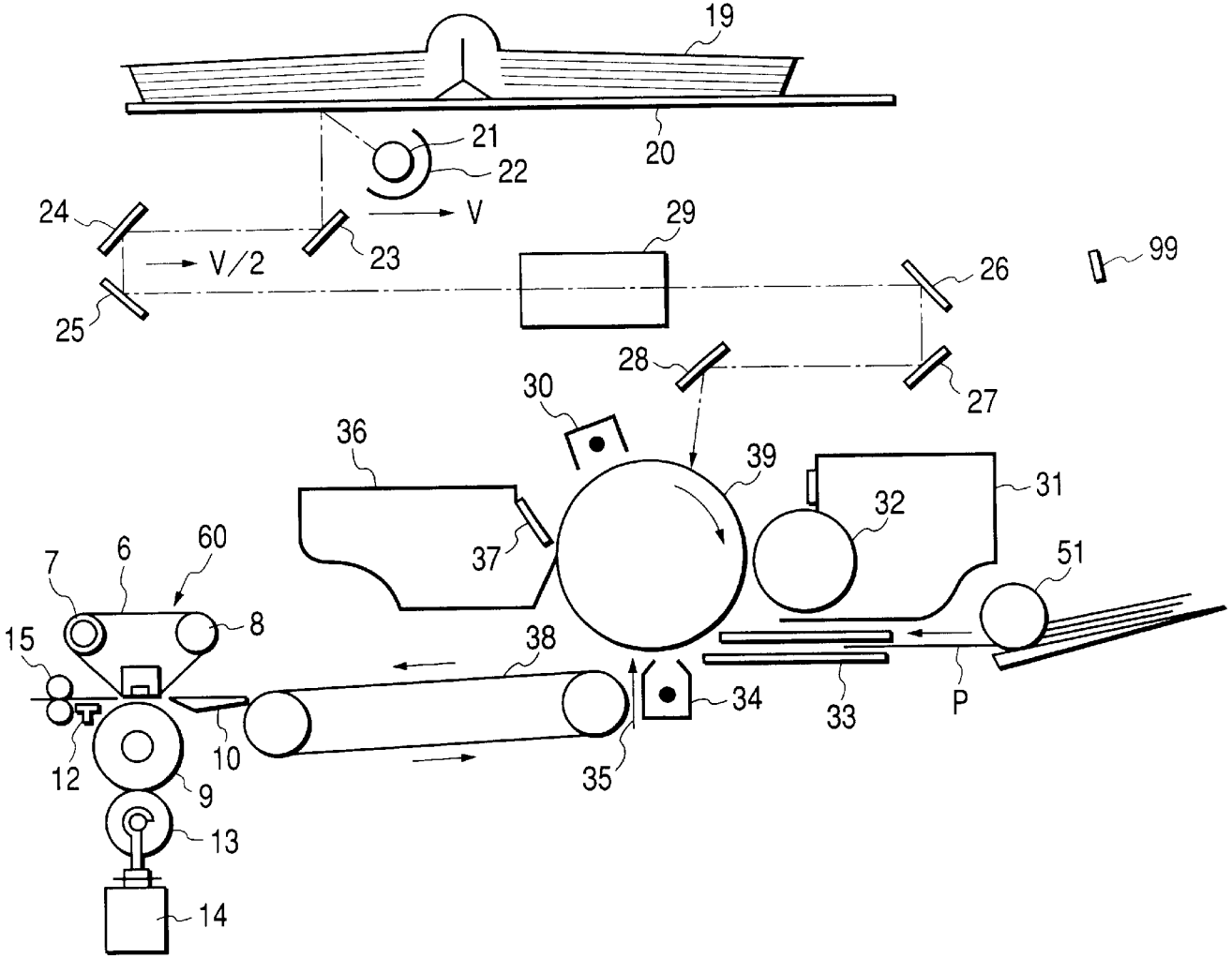
FIG. 1 is a schematic diagram showing an image forming apparatus according to a first embodiment of the present invention.

FIG. 1 is a schematic diagram showing the image forming apparatus of this embodiment.

The image forming apparatus of this embodiment shown in FIG. 1 is an electrophotographic copying apparatus of the type in which the original tray is stationary, in which the optical system moves, which has a rotating drum, and in which image transfer is effected.

That is, as shown in FIG. 1, in the image forming apparatus of this embodiment, an original 19 is placed at a predetermined position on a stationary original glass tray 20, and, after setting a desired copying condition, a copying start key is depressed, whereby a photosensitive drum 39 is rotated clockwise as indicated by the arrow at a predetermined peripheral velocity.

Further, a light source 21 (numeral 22 indicates a reflection shade) and a first mirror 23 moves along the lower surface of the original glass tray 20 at a predetermined speed V from a home position on the left-hand side of the glass to the right-hand side of the glass in the drawing, and a second mirror 24 and a third mirror 25 move in the same direction at a speed of V/2, whereby the downwardly directed image surface of the original 19 placed on the original glass tray 20 is scanned from the left-hand side to the right-hand side, and the reflection of the scanning light from the original surface is transmitted by way of an imaging lens 29 and fourth through sixth (stationary) mirrors 26, 27, and 28 to effect image formation through exposure (slit exposure) on the surface of the rotating photosensitive drum 39.

The exposed surface of the rotating photosensitive drum 39 is uniformly charged in a positive or negative predetermined potential by a primary charger 30, and the above-mentioned exposure is effected on this charged surface, whereby an electrostatic latent image in a pattern corresponding to the original image is successively formed on the surface of the photosensitive drum 39.

The electrostatic latent image formed on the surface of the photosensitive drum 39 is visualized as a toner image with toner from a developing roller 32 of a developing apparatus 31.

A recording material P is fed by a sheet feeding roller 51, and introduced through a guide 33 with a predetermined timing to a transferring portion between the photosensitive drum 39 and a transfer charger 34, and is subjected to a transfer corona to come into contact with the photosensitive drum 39, the visualized toner image on the photosensitive drum 39 being successively transferred to the surface of the recording material (the photosensitive drum 39, the developing apparatus 31, and the transfer charger 34 are main components of the image forming means).

The recording material P, which has passed the transferring portion, is successively separated from the surface of the photosensitive drum 39, while undergoing charge removal of the back side charge by a charge removing needle 35, and is introduced to a fixing apparatus 60 by way of a conveying portion 38 and an inlet guide 10, the toner image being fixed as described below before the sheet with the image is discharged to the exterior of the apparatus.

After the transfer, any stain on the surface of the photosensitive drum 39, such as toner, is removed by a cleaning blade 37 of a cleaning device 36, and the photosensitive drum 39 is therefore used for repetitive image formation.

After moving forwards as described above, the movable optical components 21 through 25 reaches a predetermined end position. Then, they move backwards to the home position to be on standby for the subsequent copying cycle (hereinafter, this process will be referred to as the optical system backward process).

When the number of copies (e.g., 100) is designated before the copying start key is depressed, the above process is repeated at a predetermined interval under the control of a microcomputer (not shown; hereinafter referred to as MPU) after the completion of the optical system backward process.

Next, the fixing apparatus 60, provided in the image forming apparatus of this embodiment, will be described in detail with reference to FIG. 2.

Figure 2:
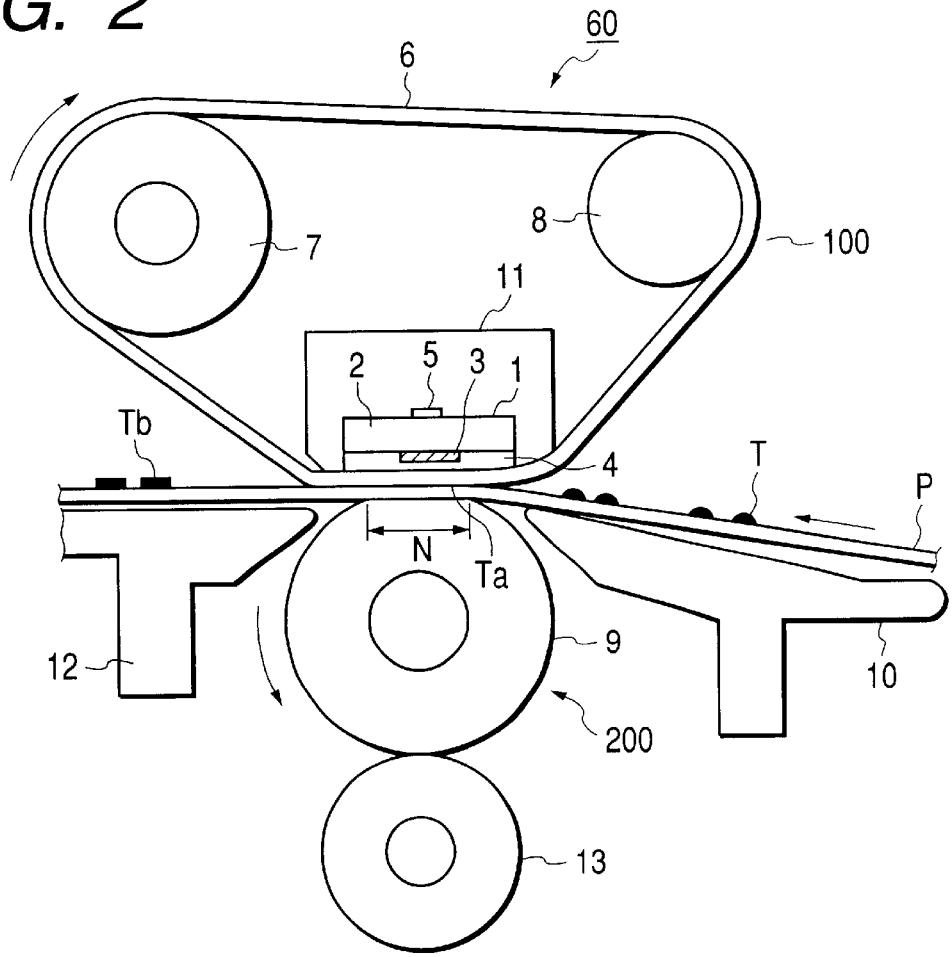
FIG. 2 is a schematic diagram showing a fixing apparatus according to the first embodiment of the present invention.

FIG. 2 is a schematic diagram showing the fixing apparatus 60 of the first embodiment of the present invention.

As shown in FIG. 2, the fixing apparatus 60 is equipped with a fixing film 6 in the form of an endless belt constituting a fixing rotating member, a heater 1 serving as heating means consisting of a linear heating member of small heat capacity, a pressurizing roller 9 constituting a fixing rotating member forming a nip with the fixing film 6, and a cleaning roller 13 constituting the removing member.

The cleaning roller 13 is a metal roller of high heat conductivity consisting of aluminum or the like, and can be detachably brought into contact with the pressurizing roller 9 by a solenoid 14.

As shown in FIG. 2, the fixing film 6 can be run by a driving roller 7 and a driven roller 8 on the left-hand side and the right-hand side in the drawing.

The heater 1 is arranged below the driving roller 7 and the driven roller 8 so as to be stationary.

Thus, the fixing film 6 is stretched between the driving roller 7, the driven roller 8, and the heater 1.

The driven roller 8 also serves as a tension roller imparting tension to the fixing film 6 so as to stretch it outwardly, and, as the driving roller 7, whose surface is covered with silicone rubber or the like to increase its coefficient of friction, rotates clockwise, the fixing film 6 is caused to run clockwise at a predetermined peripheral velocity, without involving any slack, meandering or delay.

The pressurizing roller 9 has an elastic rubber layer of a satisfactory releasing property consisting, for example, of silicone rubber, and is held in press contact with the lower side of the heater 1 by biasing means, such as a spring (not shown), through the intermediation of the lower portion of the endless-belt-like fixing film 6 with a contact force, for example, of 5 to 20 kgf (about 49 to 196 N), to define a fixing nip portion constituting the nip region, rotating counterclockwise in the direction in which the recording material P is conveyed.

The diameter of the end portions of the pressurizing roller 9 with respect to the longitudinal direction is larger than that of the central portion by approximately 50 to 500 $\mu$m.

With this arrangement, a force pulling to the end is applied to the recording material P in the fixing nip portion, thereby preventing the recording material P from being wrinkled.

The cleaning roller 13 consists of an aluminum bar, and is held in press contact with the pressurizing roller 9. In this embodiment, it is held in press contact with a contact force, for example, of 200 to 2000 gf (about 1.96 to 19.6 N) by biasing means support member, such as a spring.

Since it is repeatedly used for heat fixation of toner images, the endless fixing film 6 driven is superior in heat resistance, releasing property, and durability. Generally speaking, its thickness is preferably 100 μm or less, and more preferably, 40 μm or less.

The fixing film consists, for example, of a film of a high heat resistance resin, such as polyimide, polyether imide, polyether sulfone, polyether, or ether ketone, having a thickness of 20 μm, or a thin endless belt of a metal, such as nickel or SUS, whose outer peripheral surface is coated with a low surface energy resin, such as PTFE (tetrafluoroethylene resin) or PFA (tetrafluoroethylene/perfluoroalkylvinylether copolymer resin), or a releasing coat layer consisting of a material obtained by adding a conductive material, such as carbon black, to these resins, to a thickness of 10 μm to attain a total thickness of 30 μm.

The heater 1 of low heat capacity consists, for example, of an alumina substrate 2 having a thickness of 1.0 mm, a width of 10 mm, and a longitudinal length of 340 mm, a heat generating layer 3 formed by applying to the alumina substrate 2 a resistive material, such as silver palladium or ruthenium oxide, in a thickness of 10 μm and a width of 1.0 mm, and a protective layer 4 formed thereon to a thickness of 10 μm and consisting of glass or the like taking into account the slide contact with the fixing film 6, the heater being secured to a heater support member 11.

The heater support member 11, which supports the heater 1 in a heat insulating manner with respect to the fixing apparatus 60 and the image forming apparatus, has heat insulating property, high heat resistance, and rigidity; it consists, for example, of a high heat resistance resin, such as PPS (polyphenylene sulfide), PEEK (polyether ether ketone), or liquid crystal polymer, or a composite material obtained by combining such resins with ceramic, metal, etc.

Electricity is supplied from both ends with respect to the longitudinal directions of the heat generating layer 3 of the heater 1.

In this embodiment, the electricity supplied to the heater 1 is AC 100V; it is controlled by an MPU according to the detection temperature of a thermistor 5 consisting, for example, of an NTC thermistor, provided on the back side of the substrate 2 by adhesion by a heat conductive silicone rubber adhesive or pressure welding or by formation into an integral unit.

The heat generating layer 3 is formed linearly at the central portion of the lower side of the substrate 2 along the longitudinal direction of the substrate.

Provided at both ends of the heat generating layer 3 are electricity supply electrodes (input terminals; not shown) formed of a good conductor like silver, whereby electricity is supplied to the heat generating layer 3.

In the heater 1, the MPU controls a heater driving circuit (not shown) during fixation such that the detection output of the thermistor 5 constituting the temperature detecting element is a predetermined value, thus controlling the electricity supply to the heat generating layer 3.

In the fixing apparatus 60, through the above-described image forming operation (fixing operation), the recording material P to the upper surface of which an unfixed toner image T has been transferred is guided to a guide 10, and enters a fixing nip portion N between the heater 1 and the pressurizing roller 9 formed with the fixing film 6 therebetween.

Then, the unfixed toner image T comes into close contact with the lower surface of the fixing film 6, and, in a condition in which it is combined with the fixing film 6, passes through the fixing nip portion N under pressure without involving misregistration, wrinkling, or offsetting. The toner image bearing surface of the recording material P receives the heat from the heat generating layer 3 through the fixing film 6 while passing through the fixing nip portion N in the condition in which it is pressed against the fixing film surface, whereby the toner image is fused and softened to become an image Ta fixed to the recording material P.

In the above image forming operation, the driving roller 7 is driven at X rpm, thereby causing the fixing film 6 and the pressurizing roller to rotate to convey the recording material P.

For example, when the diameter of the driving roller 7 is 20 mm, and the conveying speed of the recording material is 100 mm/s, the driving roller 7 drives at X=95.5 rpm (about 1.59 1/s) to run the fixing film 6.

In the fixing apparatus 60 of this embodiment, the recording material P is separated from the fixing film 6 when the recording material P has passed the fixing nip portion N.

At the time of this separation, the temperature of the fused toner Ta is still higher than the glass transition point of the toner.

The toner Ta at a temperature higher than the glass transition point at the time of this separation has an appropriate rubber property, so that the toner image surface at the time of separation has appropriate surface irregularities, and is cooled and solidified while maintaining this surface property without being in conformity with the fixing film surface, with the result that no excessive image gloss is generated on the toner image surface after fixation, thus providing a high quality image.

The recording material P separated from the fixing film 6 is guided by a sheet discharging guide 12 to reach a discharging roller pair 15 and, in this while, the high-temperature toner Ta undergoes self temperature reduction (self-cooling) to reach a temperature not higher than the glass transition point to be thereby solidified to provide an image Tb.

In this embodiment, the heat generating layer 3 and the substrate 2 of the heater 1 have a small heat capacity, and are supported by the heat support member 11 in a heat insulating manner, so that the surface temperature of heater 1 at the fixing nip portion N is raised in a short time to a temperature sufficiently high with respect to the melting point of the toner. Thus, there is no need to previously raise the temperature of the heater 1 (so-called standby temperature adjustment), so that it is possible to realize energy saving and prevent temperature rise in the apparatus.

In this embodiment, each time a predetermined number of recording materials have passed the fixing apparatus 60, the apparatus is placed in the cleaning mode to clean the pressurizing roller 9.

In the cleaning mode of this embodiment, it is possible to set the following items to desired levels:

(1) fixation driving speed;
(2) execution time;
(3) heater control temperature; and
(4) execution interval (number of sheets).

In this embodiment, the following conditions were set: (1) fixation driving speed: X/2 rpm; (2) execution time: 60 seconds; (3) heater control temperature 220° C.; and (4) execution interval: 500 sheets.

When image forming operation is executed, a trace quantity of toner offset from the recording material P to the fixing film 6 is transferred to the pressurizing roller 9. In normal image forming operation, the temperature of the pressurizing roller 9 and the cleaning roller 13 is not raised to a sufficient degree, so that the residual toner on the pressurizing roller 9 is not completely collected and gradually accumulated on the pressurizing roller 9.

In this embodiment, when 500 recording materials are output, the driving roller is driven at X/2 rpm, which is slower than the speed during fixation, the heater 1 is subjected to temperature control at 220° C., which is higher than the temperature during fixation, and the cleaning mode operation is executed for 60 seconds.

By this cleaning mode, the pressurizing roller 9 and the cleaning roller 13 are heated to a sufficient degree, and the residual toner on the pressurizing roller 9 is collected substantially completely by the cleaning roller 13.

Thus, there was no image staining even after the output of 200,000 recording materials.

In this embodiment, the power consumption was 7 Wh.

As shown in Table 1, as compared with Comparative Examples 1 and 2 described below, more satisfactory results were obtained in terms of cleaning performance, power consumption, execution time, etc.

By thus lowering the driving speed of the fixing apparatus in the cleaning mode, an improvement is achieved in terms of the residual toner collecting efficiency of the cleaning roller, making it possible to shorten the cleaning mode to further achieve a reduction in power consumption.

The setting in Comparative Example 2 is as follows: (1) fixation driving speed: X rpm; (2) execution time: 90 seconds; (3) heater control temperature: 220° C.; and (4) execution interval: 500 sheets.

In Comparative Example 2, the cleaning mode execution time is prolonged, whereby, as in the first embodiment, the residual toner on the pressurizing roller 9 was collected substantially completely.

Thus, even after the output of 200,000 recording materials, no image staining occurred.

In this comparative example, the power consumption was 14 Wh.

Second Embodiment

Next, the second embodiment of the present invention will be described. In the following, the components which are the same as those of the first embodiments are indicated by the same reference numerals, and a description of such components will be omitted.

In this embodiment, the setting of the cleaning mode for the image forming apparatus of the first embodiment is changed.

The setting in this embodiment is as follows: (1) fixation driving speed: X/2 rpm; (2) execution time: 40 seconds; (3) heater control temperature: 220° C.; and (4) execution interval: 500 sheets.

In this embodiment, the execution time is set to 40 seconds, so that residual toner was gradually accumulated on the surface of the pressurizing roller 9, and after the output of 200,000 sheets, image staining of a level passable for practical use occurred in the recording materials.

The power consumption in this embodiment was 5 Wh.

Third Embodiment

Next, the third embodiment of the present invention will be described. In the following, the components which are the same as those of the first embodiments are indicated by the same reference numerals, and a description of such components will be omitted.

This embodiment differs from the first and second embodiments in the following point: when jam occurred during execution of image forming operation, the cleaning mode is executed between the instant that the jam processing is completed and the instant that the next image forming operation is started. The setting of the cleaning mode is the same as that in the first embodiment.

With this arrangement, it is possible for the cleaning roller to collect the residual toner adhering to the pressurizing

TABLE 1

| | Cleaning Mode Setting Conditions | | | | | |
|---|---|---|---|---|---|---|
| | (1) Fixation Driving Speed | (2) Execution Time | (3) Heater Control Temperature | (4) Execution Interval | Power Consumption | Image Staining |
| Embodiment 1 | X/2 rpm | 60 seconds | 220° C. | 500 recording materials | 7 Wh | 200,000 ○ recording materials |
| Embodiment 2 | X/2 rpm | 40 seconds | 220° C. | 500 recording materials | 5 Wh | 200,000 Δ recording materials |
| Comparative Example 1 | X rpm | 60 seconds | 220° C. | 500 recording materials | 10 Wh | 150,000 x recording materials |
| Comparative Example 2 | X rpm | 90 seconds | 220° C. | 500 recording materials | 14 Wh | 200,000 ○ recording materials |

Image Staining Evaluation: ○ = no problem / Δ = possible for practical use / x = not possible for practical use Comparative Example In Comparative Example 1, the setting of the cleaning mode for the image forming apparatus of the first embodiment is changed.

The setting in Comparative Example 1 is as follows: (1) fixation driving speed: X rpm; (2) execution time: 60 seconds; (3) heater control temperature: 220° C.; and (4) execution interval: 500 sheets.

In Comparative Example 1, the fixation driving speed is set to X rpm (X/60 1/s), so that the length of time that the residual toner on the pressurizing roller 9 is in contact with the cleaning roller 13 for each contact is half that in the first embodiment.

Thus, residual toner is gradually accumulated on the surface of the pressurizing roller 9, and image staining occurred in the recording materials after the output of 150,000 recording materials.

In this comparative example, the power consumption was 10 Wh.

Comparative Example 2

In Comparative Example 2, the setting of the cleaning mode for the image forming apparatus of the first embodiment is changed.

roller after the occurrence of the jam, making it possible to prevent adhesion of stain to the recording material after the occurrence of jam. Further, since the driving speed of the fixing apparatus in the cleaning mode is reduced, the residual toner collecting efficiency of the cleaning roller is improved, and the cleaning mode period is shortened, thereby achieving a further reduction in power consumption.

Fourth Embodiment

Next, the fourth embodiment of the present invention will be described. In the following, the components which are the same as those of the first embodiments are indicated by the same reference numerals, and a description of such components will be omitted.

This embodiment differs from the first through third embodiments in the following point: in the above-described embodiments of the present invention, the driving speed of the fixing apparatus is reduced when executing the cleaning mode to thereby increase the contact time of the pressurizing member and the removing member, thereby shortening the cleaning mode period and achieving a reduction in power consumption. That is, the embodiments do not involve any change in the construction of the heating member.

Figure 3:
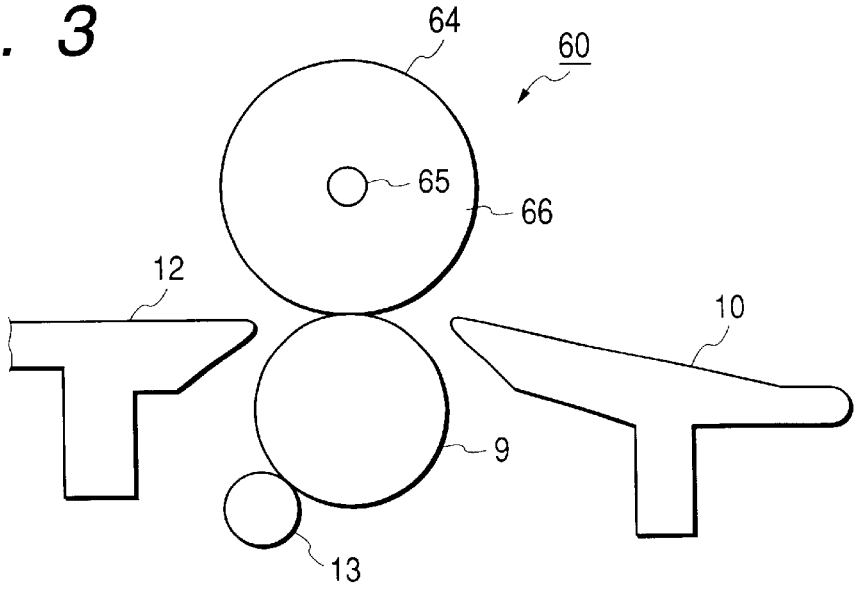
FIG. 3 is a schematic diagram showing a fixing apparatus according to a fourth embodiment of the present invention.

The present invention is applicable not only to the system in which the fixing film 6 of the first through third embodiments is used as the fixing member, but also to a heat roller system in which fixation is effected by a heating roller 64 which is composed of, as shown in FIG. 3, a roller member 66 serving as the fixing roller and a heating member 65, which is contained in the roller member 66, serving as the heating means.

The above-described embodiments of the present invention should not be construed restrictively. The present invention allows a variety of modifications without departing from the scope of the invention.

What is claimed is:

1. A fixing apparatus comprising:

a fixing rotating member for pinching and conveying a recording material supporting an unfixed image to perform fixation;

driving means for driving said fixing rotating member;

a cleaning rotating member for cleaning said fixing rotating member; and contact/separation means for bringing said cleaning rotating member into contact with and away from said fixing rotating member, wherein during cleaning by said cleaning rotating member, said driving means drives said fixing rotating member at a rotating speed lower than a rotating speed at which said fixing rotating member rotates during the fixation.

2. A fixing apparatus according to claim 1, wherein said fixing rotating member on which said cleaning rotating member performs cleaning comes into contact with a surface of the recording material on a side opposite to a surface thereof supporting the unfixed image.

3. A fixing apparatus according to claim 1, wherein said cleaning rotating member is driven by said fixing rotating member.

4. A fixing apparatus according to claim 1, further comprising control means for controlling a cleaning timing performed by said cleaning rotating member, said control means causing cleaning to be performed each time fixation has been effected a predetermined number of times.

5. A fixing apparatus according to claim 1, further comprising a heater for heating the unfixed image, wherein said cleaning rotating member is at a lower temperature than said fixing rotating member.

6. A fixing apparatus comprising:

a fixing rotating member for pinching and conveying a recording material supporting an unfixed image to perform fixation;

a heating member for heating said fixing rotating member;

electricity-supply-control means for controlling electricity supply to said heating member;

a cleaning rotating member for cleaning said fixing rotating member while being in contact with said fixing rotating member; and speed changing means for changing a rotating speed of said fixing rotating member between a fixation rotating speed during the fixation and a lower rotating speed lower than the fixation rotating speed, and for changing the rotating speed to the lower rotating speed during a cleaning mode in which an electricity-supply-control to said heating member is performed and a cleaning of said fixation rotating member is performed.

7. A fixing apparatus according to claim 6, wherein said cleaning mode is performed at an interval of a predetermined number of recording materials.

8. A fixing apparatus according to claim 6, further comprising a rotatable film in contact with said heating member, wherein said fixing rotating member cooperates with said film to form a nip for pinching and conveying the recording material.

9. A fixing apparatus according to claim 8, further comprising temperature detecting means for detecting a temperature of said heating member, wherein said electricity-supply-control means controls an electricity supply to said heating member based on the temperature detected by said temperature detecting means.

10. A fixing apparatus according to claim 6, wherein a cleaning time of said cleaning mode is preset.

11. A fixing apparatus according to claim 6, wherein said cleaning rotating member is a metal roller.

* * * * *

UNITED STATES PATENT AND TRADEMARK OFFICE

CERTIFICATE OF CORRECTION

PATENT NO. : 6,718,155 B2
DATED : April 6, 2004
INVENTOR(S) : Keigo Kaji et al.

It is certified that error appears in the above-identified patent and that said Letters Patent is hereby corrected as shown below:

Column 1,
Line 65, “once” should read -- first --.

Column 4,
Line 4, “reaches” should read -- reach --.

Column 6,
Line 31, “in this while,” should read -- meanwhile, --.

Signed and Sealed this

Seventeenth Day of August, 2004

JON W. DUDAS
*Acting Director of the United States Patent and Trademark Office*